United States Patent [19]

Schwenke

[11] 3,973,671

[45] Aug. 10, 1976

[54] APPARATUS FOR CHANGING THE ORIENTATION OF FILTER CIGARETTES OR THE LIKE

[75] Inventor: Dieter Schwenke, Hamburg, Germany

[73] Assignee: Hauni-Werke Körber & Co., KG, Hamburg, Germany

[22] Filed: Dec. 30, 1974

[21] Appl. No.: 537,669

[30] Foreign Application Priority Data

Jan. 30, 1974 Germany ..... 2404230

[52] U.S. Cl. ..... 198/248; 198/20 C; 198/32; 198/237; 198/210

[51] Int. Cl.[2] ..... B65G 47/24

[58] Field of Search..... 198/20 C, 25, 32, 235–238, 198/240, 248, 210; 308/241, DIG. 8, DIG. 9, 239

[56] References Cited

UNITED STATES PATENTS

| | | | |
|---|---|---|---|
| 2,944,654 | 7/1960 | Schubert | 198/32 |
| 2,988,198 | 6/1961 | Pinkham | 198/32 |
| 3,215,250 | 11/1965 | Schubert | 198/210 |
| 3,485,337 | 12/1969 | Everhart | 198/240 |
| 3,625,103 | 12/1971 | Giatti | 198/32 |
| 3,771,639 | 11/1973 | Giatti | 198/210 |

FOREIGN PATENTS OR APPLICATIONS

| | | | |
|---|---|---|---|
| 544,277 | 4/1942 | United Kingdom | 308/DIG. 8 |
| 994,813 | 6/1965 | United Kingdom | 198/240 |

*Primary Examiner*—Evon C. Blunk
*Assistant Examiner*—Joseph E. Valenza
*Attorney, Agent, or Firm*—Peter K. Kontler; John Kurucz

[57] ABSTRACT

A turn-around device for filter cigarettes has a fluted conveyor which transports a row of filter cigarettes to be turned end-for-end to a first transfer station where the cigarettes are picked up by successive suction heads of a first set and are transpoted to a second transfer station while being simultaneously reoriented by 90°. At the second transfer station, the partially reoriented cigarettes are transferred into successive suction heads of a second set which complete the reorientation and insert the inverted cigarettes into empty flutes of the conveyor at the first station. The suction heads of the first set are mounted on first links each of which is articulately connected to two disk-shaped supports rotating about parallel axes. The suction heads of the second set are mounted on second links each of which is articulately connected to two disk-shaped supports rotating about parallel axes. One support for the first links is coaxial with one support for the second links. The other support for the first links is coaxial with or eccentric with respect to the other support for the second links, depending upon whether the flutes for cigarettes to be turned are aligned with or staggered with respect to the flutes for the reoriented cigarettes.

19 Claims, 6 Drawing Figures

143
157
158
183
184
147
186
187
188
148

VI
VI
184
148
165A
161
151
B
159
149
147
183
151
A
164
161
165A
167B
t4
t3
t2
t1
x
x
149
159
164
165A
165B
167A
167

APPARATUS FOR CHANGING THE ORIENTATION OF FILTER CIGARETTES OR THE LIKE

BACKGROUND OF THE INVENTION

THe present invention relates to turn-around devices for rod-shaped articles, such as filter rod sections or plain or filter-tipped cigarettes, cigars or cigarillos. More particularly, the invention relates to a device which is especially suited for turning end-for-end successive filter-tipped cigarettes, cigars or cigarillos in machines which produce filter-tipped articles of double unit length and comprise means for severing each article of double unit length midway between its ends to thus produce pairs of filter-tipped articles of unit length wherein the filter tips of each pair of articles are adjacent to each other. The invention will be described with reference to a turn-around device for filter cigarettes of unit length; however, it will be understood that the improved device can be used with equal advantage for tip turning of other types of rod-shaped articles which are transported sideways in the form of a row and must be turned or reoriented end-for-end.

A filter cigarette making machine normally produces a row of filter cigarettes of double unit length, and each such cigarette is thereupon severed midway across its filter tip of double unit length to yield two coaxial cigarettes of unit length. One cigarette of each pair must be turned or reoriented end-for-end in order to insure that the filter tips of all cigarettes face in the same direction. This is desirable for a number of reasons, i.e., to facilitate the testing of cigarettes for the density of free ends of their tobacco fillers as well as to insure that the filter tips of all cigarettes which enter the customary chargers or trays or are fed directly into the magazine of a packing machine face in the same direction.

German Offenlegungsschrift No. 1,901,618 discloses a turn-around device for filter cigarettes wherein a conveyor transports pairs of coaxial filter cigarettes of unit length in such a way that the filter tips of cigarettes forming a pair are adjacent to each other. The turn-around device further comprises a mechanism which causes one cigarette of each pair to travel along an arcuate circular path and to change its orientation by 180° before the thus reoriented cigarette is redeposited onto the conveyor, preferably into an empty flute between two non-inverted cigarettes. The mechanism comprises first cigarette carriers in the form of suction heads which lift cigarettes to be turned off the conveyor and transport them along one-half of the aforementioned circular path with simultaneous reorientation by 90°. The mechanism further comprises second cigarette carriers which accept partially reoriented cigarettes from successive first carriers and transport such cigarettes along the other half of the circular path with simultaneous reorientation by 90° before the tip turned cigarettes are redeposited on the conveyor. The second carriers are mirror symmetrical to the first carriers, and each carrier is pivotable by a lever having a first end articulately connected to a rotary support and a second end travelling in a stationary circular guide groove. The center of the groove for the levers which support the first carriers is eccentric to the axis of the respective rotary support, and the position of the center of the groove for the levers which support the second carriers with respect to the corresponding rotary support is analogous. The eccentricity of the groove with respect to the corresponding rotary supports is selected with a view to effect partial reorientation of cigarettes during travel with the first carriers and to effect the remainder of reorientation during travel with the second carriers.

A drawback of the just described turn-around device is that the end portions of levers which travel in the guide grooves are subjected to extensive wear and to substantial deforming stresses. As a rule, the corresponding ends of the levers carry followers which roll along the surfaces bounding the respective grooves, and the ends of the levers must be free to swivel in the respective grooves. To this end, the followers are preferably spheres whose surfaces undergo extensive wear so that the useful life of such followers is extremely short. Furthermore, the frictional engagement between spherical followers and surfaces bounding the grooves produces substantial amounts of heat with attendant expansion of followers which are thereby likely to become stuck in the grooves, especially since the carriers must be guided with a high degree of accuracy so that the clearances between the grooves and the followers therein must be held to a minimum. The surfaces bounding the grooves surround the followers from three sides so that the dissipation of heat is negligible, and this further enhances the likelihood of jamming.

SUMMARY OF THE INVENTION

An object of the invention is to provide a turnaround device for filter cigarettes or analogous rod-shaped articles which can stand long periods of uninterrupted use, wherein the moving parts are subjected to negligible wear, wherein the likelihood of overheating and jamming is much less pronounced than in heretofore known turn-around devices, and which can be used for reorientation of filter cigarettes or the like at the rate at which such articles issue from or are being transported in a mass-producing machine.

Another object of the invention is to provide a simple and compact turn-around device which is especially suited for tip-turning of one of each pair of coaxial filter cigarettes of unit length and which can automatically place the reoriented articles between non-inverted articles or adjacent to non-inverted articles.

A further object of the invention is to provide novel and improved means for moving the article carriers in a turn-around device for filter cigarettes or analogous rod-shaped articles.

An additional object of the invention is to provide a turn-around device which can be installed in existing filter cigarette making or like machines as a superior substitute for existing turn-around devices.

Still another object of the invention is to provide novel and improved supports for use in the turn-around device as a means for effecting movements of suction heads of analogous article carriers along predetermined paths with a maximum degree of reproducibility, with a minimum of wear and without any danger of damaging and/or contaminating the articles.

The improved turn-around device for cigarettes or analogous rod-shaped articles comprises first conveyor means (e.g., a rotary drum) having a plurality of first receiving means for articles to be turned, a plurality of second receiving means for tip turned articles and means for moving the receiving means sideways along parallel first and second paths and past a first transfer station (the receiving means may constitute parallel flutes which are machined into the periphery of the drum and each first receiving means may be aligned with or staggered with respect to the second receiving means), and second conveyor means having annuli of first and second links which are respectively adjacent to the first and second paths. The second conveyor means further comprises first and second suction heads or analogous article carriers respectively mounted on the first and second links, first and second rotary supports, universal joints or analogous means for articulately connecting the supports with the first links, means for rotating the supports about parallel axes to thereby move the first links along a first endless path having a first portion which is adjacent to the first transfer station and in which successive first carriers remove articles from successive first receiving means of the first conveyor means and a second portion which is adjacent to a second transfer station and in which successive first carriers maintain the articles substantially at right angles to the receiving means to thus complete one-half of reorientation or tip turning of such articles, third and fourth rotary supports, means for articulately connecting the second links to the third and fourth supports, and means for rotating the third and fourth supports about parallel axes to thereby move the second links along a second endless path having a first portion which is adjacent to the second transfer station and in which successive second carriers accept articles from successive first carriers and a second portion which is adjacent to the first transfer station and in which successive second carriers deliver tip turned articles into successive second receiving means.

The novel features which are considered as characteristic of the invention are set forth in particular in the appended claims. The improved turn-around device itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
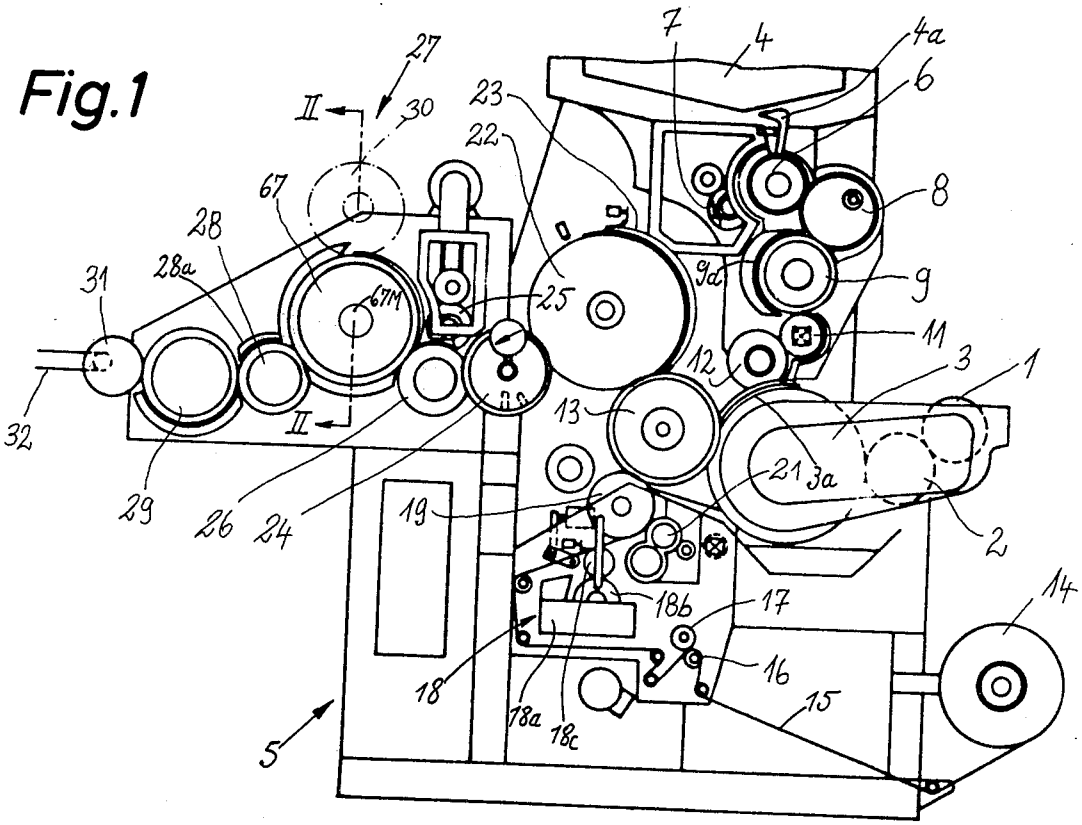
FIG. 1 is a schematic elevational view of a filter cigarette makingmachine including a turn-around device which embodies one form of the invention.

FIG. 1 shows a filter cigarette making machine which embodies one form of the improved turn-around device. The machine is of the type known as MAX (trademark) produced by Hauni-Werke, Korber & Co. KG, of Hamburg-Bergedorf, Western Germany, and is directly coupled with a cigarette rod making machine, e.g., with a machine known as GARANT (trademark) also produced by Hauni-Werke and having means for producing a continuous wrapped tobacco filler rod which is subdivided into plain cigarettes of unit length.

FIG. 1 merely shows a rotary drum-shaped row-forming conveyor 1 which forms part of the cigarette rod making machine and has peripheral flutes each of which contains a plain cigarette. The cigarettes in the flutes of the conveyor 1 form two rows, and the cigarettes of one row are staggered with respect to the cigarettes of the other row, as considered in the circumferential direction of the conveyor 1. Thus, the cigarettes of one row occupy oddly numbered flutes and are nearer to one axial end, and the cigarettes of the other row occupy evenly numbered flutes and are nearer to the other axial end of the conveyor 1.

The filter cigarette making machine comprises a frame 5 which supports two coaxial rotary drum-shaped aligning conveyors 2 (only one shown) which are adjacent to and each of which receives one row of plain cigarettes of unit length from the conveyor 1. The conveyors 2 are driven at different speeds and/or transport the respective plain cigarettes through different distances so that each cigarette of one row is aligned with a cigarette of the other row not later than during transfer of the thus obtained pairs of aligned plain cigarettes into successive flutes of a rotary drum-shaped assembly conveyor 3. The cigarettes in the flutes of the assembly conveyor 3 are spaced apart from each other so as to form gaps wide enough to receive filter rod sections or filter plugs of double unit length. As a rule, the width of each gap at least slightly exceeds the length of a filter rod section of double unit length.

The top portion of the frame 5 supports a magazine or hopper 4 for a supply of parallel filter rod sections of six times unit length. The hopper 4 has an outlet communicating with a downwardly extending duct **4*a* for a single row of parallel filter rod sections of six times unit length. The duct 4*a* feeds such sections into successive flutes of a rotary drum-shaped severing conveyor 6 which cooperates with two rotary disk-shaped knives 7 to subdivide each filter rod section of six times unit length into a group of three coaxial filter rod sections or filter plugs of double unit length. One filter plug of each group is transferred into a flute of one of three rotary drum-shaped staggering conveyors 8 (only one shown in FIG. 1) which transport the respective plugs through different distances and/or at different speeds so that the filter plugs of each group are staggered with respect to each other, as considered in the circumferential direction of the conveyor 8 shown in FIG. 1. The conveyors 8 introduce discrete filter plugs into successive flutes of a rotary drum-shaped shuffling conveyor 9 which cooperates with one or two stationary cams 9*a* to shift certain filter plugs axially in order to form a single row of filter plugs wherein each preceding plug is in exact register with the next-following plug. The filter plugs of the thus obtained single row are introduced into successive flutes of a rotary drum-shaped transfer conveyor 11 which feeds the filter plugs into successive flutes of a rotary drum-shaped accelerating conveyor 12. The latter inserts successive filter plugs into successive flutes of the assembly conveyor 3 so that each flute of the conveyor 3 which advances beyond the transfer station between the conveyors 3 and 12 contains a group of three coaxial rod-shaped articles including two spaced-apart plain cigarettes of unit length and a filter plug therebetween. Such groups are caused to advance between two stationary condensing cams 3*a* which cause at least one plain cigarette of each group to move axially toward the other plain cigarette of the same group and to thus move the plain cigarettes into actual abutment with the adjacent end faces of the respective filter plug. The thus obtained condensed groups are thereupon introduced into successive flutes of a rotary drum-shaped transfer conveyor 13.**

The frame 5 further supports a bobbin 14 which contains a supply of convoluted cigarette paper, imitation cork or other suitable web material 15 capable of being converted into adhesive-coated uniting bands. The web 15 is moved lengthwise by two advancing rolls 16, 17 and thereupon above and into contact with a roller-shaped applicator 18*c* forming part of a paster 18 which further includes a vessel or tank 18*a* for a supply of adhesive paste and a roller 18*b* which dips into the supply of paste in the tank 18*a* and transfers a film of adhesive to the peripheral surface of the applicator 18*c*.

The leader of the web 15 is attracted to the peripheral surface of a suction drum 19 which cooperates with a rotary knife 21 to sever the leader at regular intervals so that the web 15 yields a succession of uniting bands each of which has an uncoated side (attracted by suction to the peripheral surface of the suction drum 19) and a second side which is coated with adhesive. The drum 19 attaches successive uniting bands to the groups in successive flutes of the transfer conveyor 13 in such a way that the coated side of each uniting band is in linear contact with the peripheral surface of the adjacent filter plug and with the inner end portions of the respective plain cigarettes. The groups (each of which carries a uniting band) are thereupon transferred onto a rotary drum-shaped wrapping conveyor 22 cooperating with a stationary or mobile rolling device 23 to cause each group to roll about its own axis whereby the respective uniting band is converted into a tube which sealingly surrounds the respective filter plug and the adjacent inner end portions of the associated plain cigarettes, i.e., each such group is converted into a filter cigarette of double unit length.

Successive filter cigarettes of double unit length are introduced into successive flutes of a rotary drum-shaped conveyor 24 forming part of a first testing unit which further comprises means for detecting the presence or absence of leaks, holes, open seams and/or other defects of the wrappers of successive cigarettes and means for producing signals which are used to effect segregation of cigarettes with defective wrappers from satisfactory cigarettes. At least the satisfactory cigarettes of double unit length are thereupon transferred into the flutes of a rotary drum-shaped severing conveyor 26 cooperating with a rotary disk-shaped knife 25 to sever each filter cigarette of double unit length midway between its ends (i.e., midway across the convoluted uniting band and the filter plug) whereby each cigarette of double unit length yields a pair of coaxial filter cigarettes of unit length. Such pairs of cigarettes of unit length are introduced into a turn-around device 27 which is constructed in accordance with one embodiment of the invention and serves to invert or reorient one filter cigarette of each pair end-for-end and to preferably (but not necessarily) insert the thus inverted cigarette into the space between two adjacent non-inverted filter cigarettes of unit length. Thus, the device 27 may form a single row of filter cigarettes of unit length wherein the filter plugs of all cigarettes face in the same direction.

Successive filter cigarettes of the thus obtained single row are introduced into successive flutes of a rotary drum-shaped transfer conveyor 28 which introduces the cigarettes into successive flutes of a rotary drum-shaped conveyor 29 forming part of a second testing unit having means for determining the density of the free ends of tobacco fillers in successive filter cigarettes of unit length. The second testing unit further comprises means for producing signals in response to detection of cigarettes with defective tobacco filler ends, and such signals are used for segregation of defective cigarettes from satisfactory cigarettes. At least the satisfactory filter cigarettes of unit length are accepted by a rotary drum-shaped transfer conveyor 31 which deposits them on the upper reach or stretch of an endless take-off conveyor belt 32 serving to transport filter cigarettes to storage, to a tray filling apparatus or directly into the magazine of a packing machine, not shown.

Figure 2:
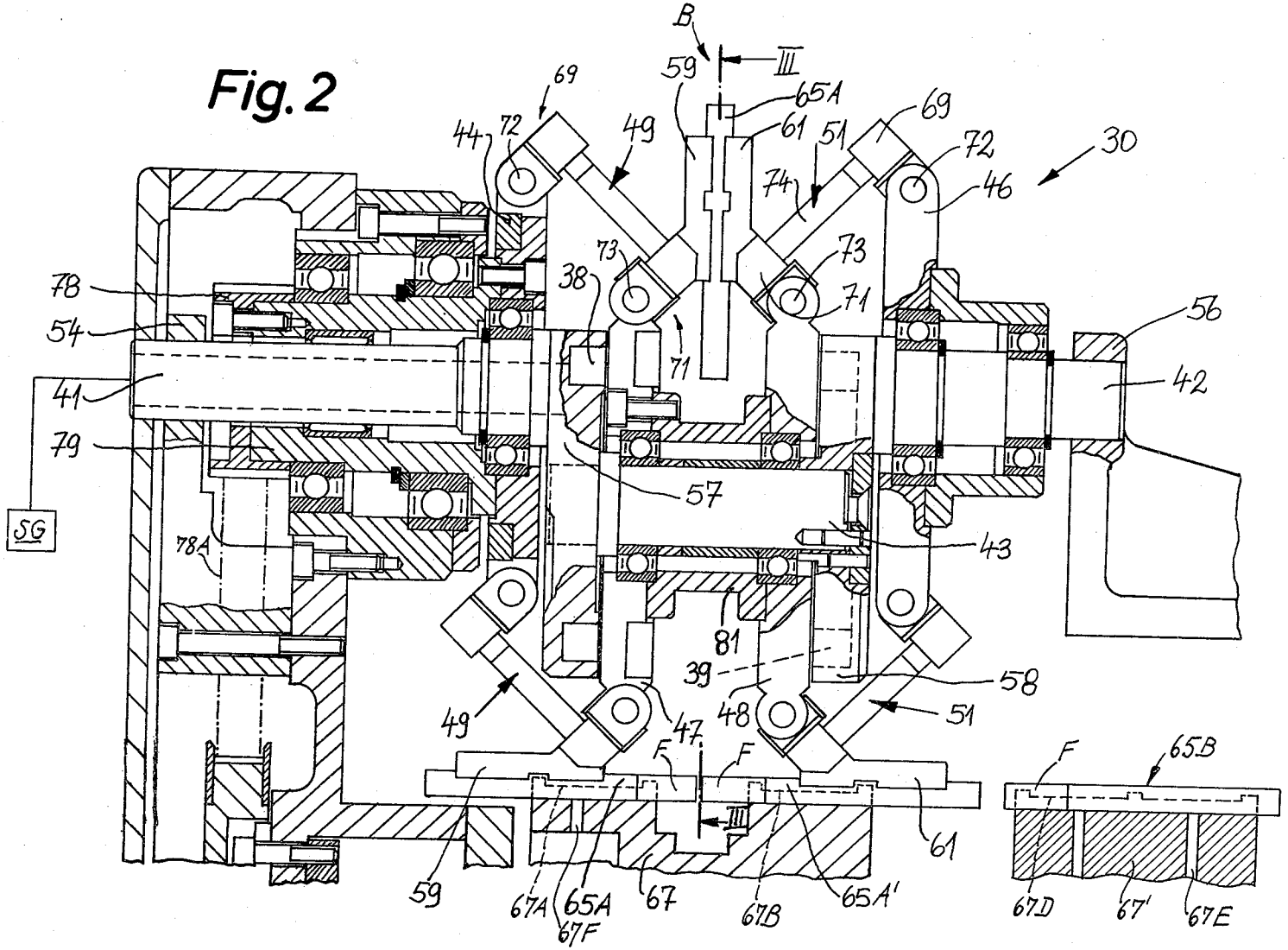
FIG. 2 is a fragmentary sectional view of the turn-around device, substantially as seen in the direction of arrows from the line II—II of FIG. 1.
Figure 4:
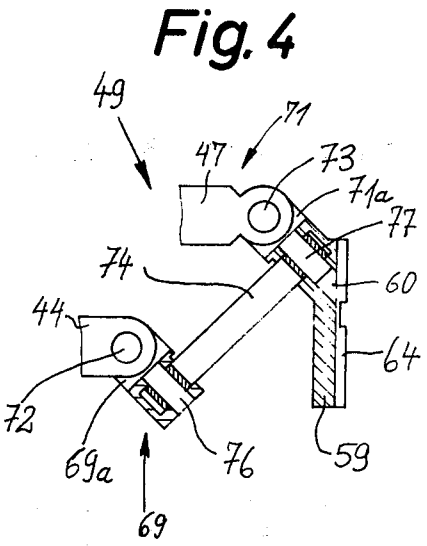
FIG. 4 is a sectional view substantially as seen in the direction of arrows from the line IV—IV of FIG. 3.
Figure 3:
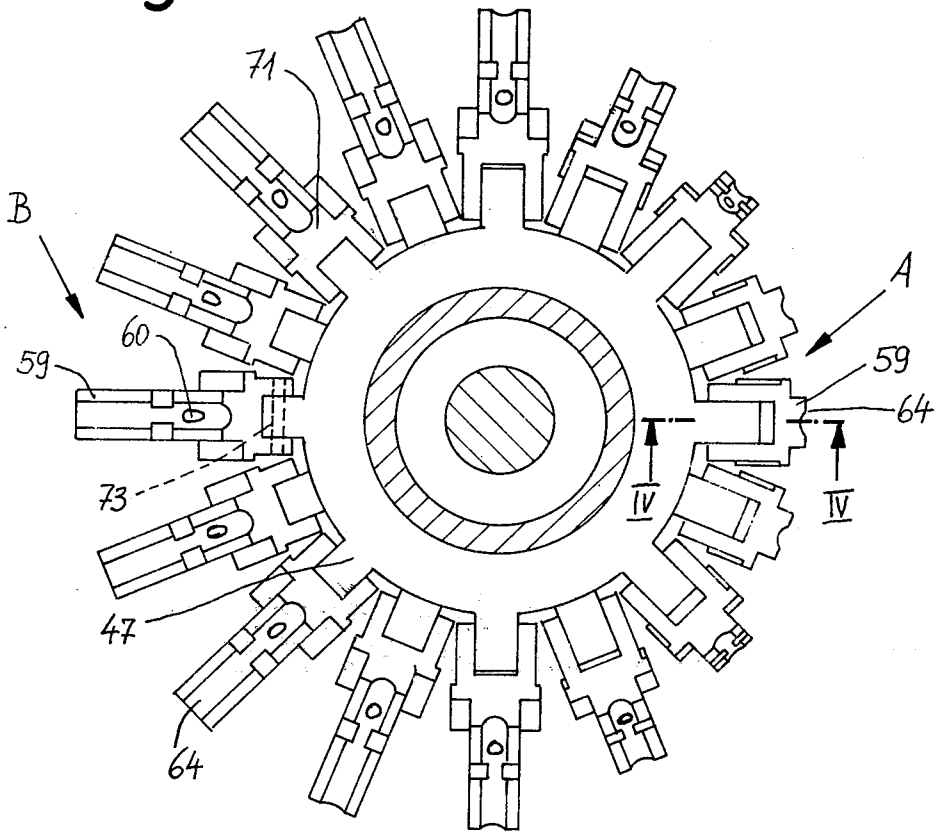
FIG. 3 is a sectional view as seen in the direction of arrows from the line III—III of FIG. 2.
Figures 5, 6:
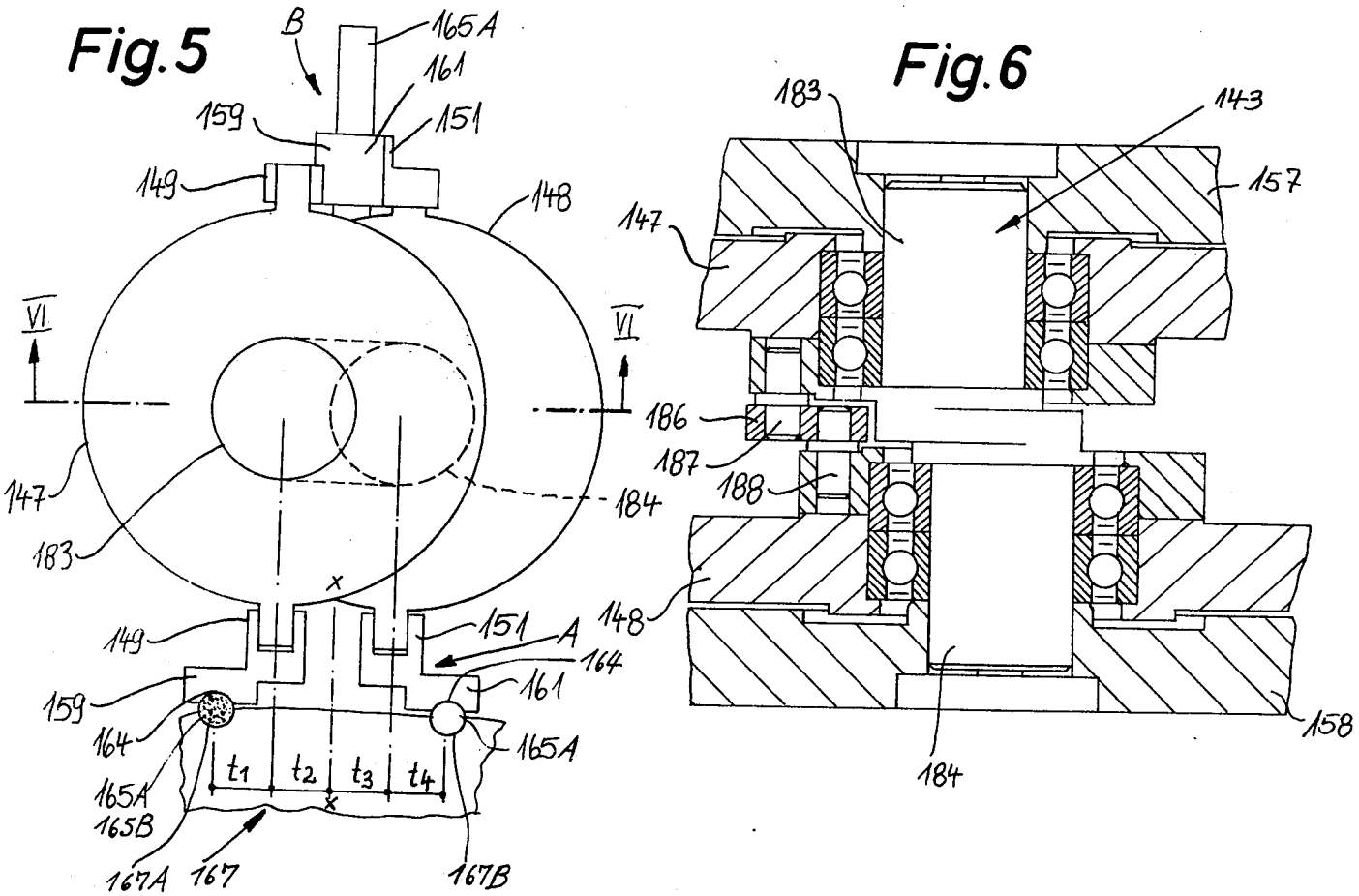
FIG. 5 is a partly diagrammatic end elevational view of a second turn-around device.
FIG. 6 is a sectional view as seen in the direction of arrows from the line VI—VI of FIG. 5.

The turn-around device 27 is shown in detail in FIGS. 2 to 4. It comprises a first rotary drum-shaped conveyor 67 which is assumed to have an uneven number of pairwise arranged receiving means or flutes 67A and 67B. An auxiliary drum-shaped conveyor 67′ of the turn-around device 27 is adjacent to one end of the conveyor 67 and has peripheral receiving means or flutes 67D. The severing conveyor 26 of FIG. 1 cooperates with mechanical means (e.g., a cam) or is provided with pneumatic means for moving the filter cigarettes 65A, 65B of each pair of coaxial filter cigarettes of unit length away from each other not later than during transfer onto the conveyors 67, 67′ of the turn-around device 27. As shown in FIG. 2, the filter cigarettes 67B which need not be inverted are received in successive flutes 67D of the conveyor 67′ and the filter cigarettes 65A which must be reoriented or inverted end-for-end are received in successive flutes 67A of the conveyor 67. Each inverted cigarette 65A′ is introduced into one of the flutes 67B of the conveyor 67. The conveyor 67 is driven by a shaft 67M (FIG. 1) at a speed which is different from the speed of the conveyor 67′ or the conveyor 67 transports the cigarettes 65A through different distances so that the inverted cigarettes 65A′ are staggered with respect to the cigarettes 65B, as considered in the circumferential direction of the conveyor 67 or 67′, not later than at the transfer station between the conveyors 67, 67′ on the one hand and the conveyor 28 on the other hand. The non-inverted cigarettes 65B are received in evenly numbered flutes and the inverted cigarettes 65A are received in oddly numbered flutes of the conveyor 28. The latter cooperates with stationary cam means 28a to shift the cigarettes 65A′ and/or 65B axially and to thus form a single row wherein the cigarettes 65A′ alternate with the cigarettes 65B not later than at the point of transfer into successive flutes of the conveyor 29. It will be seen that the filter plug F of each inverted cigarette 65A′ faces in the same direction as the filter plug F of each non-inverted cigarette 65B. The conveyor 67′ has suction ports 67E which communicate with a suction generating device (not shown) in order to retain the cigarettes 65B in the respective flutes 67D during transport from the transfer station between the conveyor 26 and 67′ to the transfer station between the conveyors 67′ and 28. Another mode of forming a single row which consists of alternating inverted and non-inverted cigarettes will be described in connection with the apparatus which is shown in FIGS. 5–6 and which can dispense with the conveyor 67′ of FIG. 2.

It will be seen that, as concerns the cigarettes 65B, the conveyor 67' of the turn-around device 27 constitutes a simple intermediate conveyor or transfer conveyor which transports such cigarettes from the flutes of the severing conveyor 26 into alternate flutes of the conveyor 28. The conveyors 26, 67', 28 or 26, 67, 28 are assumed to be driven at the same peripheral speed and the distance between the centers of two neighboring flutes of the conveyor 67 or 67' equals the distance between the centers of two neighboring flutes of the conveyor 26 or 28.

The turn-around device further comprises a second or reorienting conveyor 30 which, in the embodiment of FIGS. 1 to 4, is assumed to be located at a level above the conveyor 67 and includes two coaxial shafts 41, 42 and a third shaft 43 which is parallel to but mounted laterally of the shafts 41, 42. That end portion of the shaft 41 which is nearer to the intermediate shaft 43 mounts a disk-shaped support 44, and that end portion of the shaft 42 which is nearer to the shaft 43 mounts a disk-shaped support 46. The intermediate shaft 43 mounts two supports 47, 48 which are respectively adjacent to the supports 44, 46. The supports 44, 47 are articulately connected with a set of links 49, and the supports 46, 48 are articulately connected with a set of links 51. The links 49 and 51 respectively support trough-shaped cigarette carriers or suction heads 59, 61. Each of the carriers 59, 61 has a longitudinally extending receiving means or flute 64.

The shaft 41 is fixedly mounted in a first portion 54 and the shaft 42 is fixedly mounted in a second portion 56 of a stationary housing which can form part of or is attached to the frame 5 of the filter cigarette making machine. The rightmost portion of the shaft 41 (as viewed in FIG. 2) is fixed to a holder or cheek 57, and the leftmost portion of the shaft 42 is fixed to a holder or cheek 58. These cheeks are respectively disposed between the supports 44, 47 and 46, 48 and eccentrically support the intermediate shaft 43. The shaft 43 is fixed to the cheeks 57, 58 and the cheeks 57, 58 are fixed to the respective shafts 41, 42. The eccentricity of supports 57, 58 with respect to the supports 44, 46 matches the eccentricity of intermediate shaft 43 with respect to the shafts 41, 42.

The flutes 64 of the carriers 59, 61 are parallel to the adjacent flutes 67A, 67B when they are nearest to the conveyor 67, and each flute 64 is bounded by a concave surface whose radius of curvature equals or approximates the radius of a filter cigarette 65A or 65B. The carriers 59, 61 are provided with suction ports 60 (FIGS. 3 and 4) which are in communication with the inlet of a suction generating device SG (e.g., a fan) as long as they receive cigarettes 65A. The carriers 59 serve to remove filter cigarettes 65A from the adjacent flutes 67A and to deliver such cigarettes to the carriers 61, and the carriers 61 deliver reoriented filter cigarettes 65A' into successive empty flutes 67B of the conveyor 67. The inversion or reorientation takes place while the cigarettes 65A travel with the carriers 59 and 61.

The carriers 59, 61 are disposed in pairs and are moved in such a way that the carrier 59 of a pair accepts a cigarette 65A from the adjacent flute 67A when the carrier 61 of the same pair deposits an inverted cigarette 65A' in an empty flute 67B. The carriers 59, 61 of the same pair face each other (in a manner as shown in the upper central portion of FIG. 2) after they complete an angular movement of 180 degrees about the common axis of the shafts 41, 42, and the carriers 59, 61 of the same pair again approach the conveyor 67 after another angular displacement of 180 degrees whereby the carrier 59 again accepts a cigarette 65A and the carrier 61 of the same pair again deposits an inverted cigarette 65A' into the adjacent flute 67B. A cigarette 65A which has been transferred into the flute 64 of a carrier 59 is reoriented by 90 degrees during travel with the carrier 59 and thereupon again by 90° during travel with the carrier 61 of the same pair. This completes an inversion of the cigarette 65A end-for-end. It will be seen that, owing to the eccentricity of intermediate shaft 43 with respect to the shafts 41, 42, and assuming that the cigarettes 65A, 65B on the conveyor 67 are horizontal, the carriers 59, 61 are horizontal when they are immediately adjacent to the conveyor 67 and are vertical when they are remotest from the conveyor 67.

When the supports 44, 46 rotate about the common axis of the shafts 41, 42, the supports 47, 48 rotate about the axis of the shaft 43 whereby the relationship of the peripheral surfaces of the supports 44, 46 with respect to the peripheral surfaces of the supports 47, 48 changes continuously during each and every revolution of the supports. Therefore, the mounting of the links 49, 51 must be such that these links do not interfere with the just described relative movement of the peripheral surfaces of supports 44, 46 on the one hand and the supports 47, 48 on the other hand. To this end, the end portions of each link 51 are articulately connected with the supports 46, 48 by universal joints 69, 71. Similar joints are provided between the end portions of the links 49 and the supports 44, 47. For example, each of the joints 69, 71 may constitute a Cardanic joint. As shown in FIG. 4, the supports 44, 46 respectively carry pivot pins 72, 73 which are tangential to the respective carriers, parallel to each other and normal to (and cross in space with) the axis of the shaft 41. The universal joints 69, 71 respectively further comprise bearing members **69*a*, 71*a* which are pivotable on the pins 72, 73 and carry pivot pins 76, 77 which are normal to the respective pins 72, 73. The link 49 has an elongated rod-shaped coupling element 74 whose ends are pivotable on the pins 76, 77. The carrier 59 is rigid with the bearing member 71a, i.e., the rod 74 can move with respect to the carrier 59. The suction port 60 of FIG. 4 communicates with the suction generating device SG by way of channel means or passages provided in the pin 77, bearing member 71a, pin 73 and support 47 in certain angular positions of this support 47 so that a cigarette 65A which is transferred into the flute 64 is attracted to the carrier 59 by suction during travel from the conveyor 67 to a transfer station 3 where the cigarette is accepted by the associated carrier 61 for transport into an empty flute 67B of the conveyor 67. The lower end portion of the coupling element 74 (as viewed in FIG. 4) can pivot about the axis of the pin 72 and/or 76, and the upper end portion of the element 74 can pivot about the axis of the pin 73 and/or 77. The pins 72, 73, 76, 77** preferably consist of hardened steel and rotate in parts which are made of steel and whose surfaces are preferably nitrided. This renders it possible to avoid lubrication of these pins.

When the carrier 59 or 61 is adjacent to the conveyor 67, it is coplanar with the respective coupling element 74. When the supports 44, 46, 47, 48 thereupon move such carriers 59, 61 away from the conveyor 67, the elements 74 begin to turn with respect to the associated carriers 59, 61 and assume positions of maximum inclination with respect to such carriers after an angular displacement of supports through 90 degrees. The inclination of the elements 74 relative to the corresponding carriers 59, 61 thereupon begins to decrease and the elements 74 return into the planes of the carriers 59, 61 at the transfer station B. The coupling elements 74 thereupon again move angularly with respect to associated carriers 59, 61 (but in the opposite direction) during the third quarter of a full revolution of supports 44, 46, 47, 48 and begin to move back toward the planes of the corresponding carriers during the last quarter of the revolution of supports. The elements 74 are preferably round and their end portions are configurated in such a way that they fit snugly into sockets provided therefor in the bearing members 69a, 71a. However, it is also possible to use coupling elements 74 having a polygonal (e.g., rectangular or square) outline as long as their end portions can perform requisite movements in the sockets of the members 69*a*, 71*a*.

FIG. 3 shows successive stages of angular displacement of carriers 59 during a full revolution of the corresponding supports 44, 47. It is assumed that the turnaround device 27 comprises sixteen carriers 59 and an equal number of carriers 61. At the transfer station A, a carrier 59 is immediately adjacent to the conveyor 67 of FIG. 2 and is horizontal so that it can properly accept a horizontal cigarette 65A from the adjacent flute 67A of the conveyor 67. As mentioned above, the cigarette 65A is transferred into the flute 64 of the carriere 59 because the port 60 is then connected to the inlet of the suction generating device SG and the port 67F in the flute 67A of the conveyor 67 (see FIG. 2) is then disconnected from the suction generating device. The support 47 is assumed to rotate clockwise, as viewed in FIG. 3, whereby the inclination of the carrier 59 (which transports a cigarette 65A) changes from horizontal toward vertical and the carrier assumes a vertical position at the transfer station B. The carrier 59 is then immediately adjacent and mirror symmetrical with respect to the associated carrier 61, and its suction port 60 is disconnected from the suction generating device SG. On the other hand, the suction port of the carrier 61 is connected with the suction generating device SG so that the cigarette 65A leaves the flute 64 of the carrier 59 and automatically enters and is attracted to the flute 64 of the carrier 61. The inclination of the carrier 59 (which is now empty) thereupon gradually changes from vertical toward horizontal and the carrier 59 reassumes the horizontal position not later than when it reaches the transfer station A. The carriers 61 are substantially mirror symmetrical to the carriers 59, i.e., they also change their positions between horizontal at the transfer station A and vertical at the transfer station B. The suction port of the flute 64 in a carrier 61 which reaches the transfer station A is automatically disconnected from the suction generating device SG while the suction port or ports in the adjacent empty flute 67B are connected to the suction generating device for the conveyor 67 so that the inverted cigarette 65A' returns onto the conveyor 67 and is advanced toward the conveyor 28 of FIG. 1. Each revolution of supports 44, 46, 47, 48 entails a reorientation or end-for-end turning of a cigarette 65A through 180°, and the corresponding coupling element 74 moves twice into the plane of and twice into a position of maximum angular displacement relative to the associated carrier 59 or 61. As mentioned above, in order to reach one position of maximum angular displacement, the element 74 must pivot in a first direction and turns in a different direction (with respect to the associated carrier 59 or 61) during movement to the other position of maximum angular displacement.

The suction generating device SG is connected with the ports 60 of carriers 59, 61 by means of the aforementioned channels or passages portions of which preferably extend through the shafts 41, 42, cheeks 57, 58 and pivot pins 73. Those angular positions of carriers 59, 61 in which their ports 60 communicate (or do not communicate) with the suction generating device SG are determined by the rotating supports 47, 48 which act not unlike valve plates and have grooves which communicate with channel portions 38, 39 in cheeks 57, 58 in certain angular positions thereof.

The conveyors 67 and 67' are rotated by the main prime mover (not shown) which is installed in, on or adjacent to the frame 5 of the filter cigarette making machine. The main prime mover drives the shaft 67M for the conveyor 67 in synchronism with other conveyors and moving parts of the machine. The support 44 is rotated by a rotary driving member here shown as a sprocket wheel 78 which is rotatably mounted in the housing portion 54 and receives torque from the main prime mover through the medium of a chain or toothed belt 78A. The sprocket wheel 78 drives a sleeve 79 which is rotatable in and on suitable antifriction bearings and is rigid with the support 44. The support 44 rotates the support 47 through the medium of the links 49, and the support 47 rotates the support 48 through the medium of a combined connecting sleeve and distancing member 81 rotatable on the shaft 43. The support 46 is driven by the support 48 by way of the links 51.

A cigarette 65A which is accepted by the carrier 59 shown in the lower part of FIG. 2 (i.e., at the transfer station A of FIG. 3) is reoriented by 90° while the respective carrier 49 completes one-half of a revolution about the axis of the shaft 41 so that the axis of the partially reoriented cigarette is vertical (as viewed in FIG. 2) when it reaches the transfer station B. It will be seen that a cigarette 65A which is about to be inverted or reoriented is parallel with the axis of the shaft 41 at the transfer station A but is normal to such axis at the transfer station B of FIG. 3.

When the partially reoriented cigarette 65A reaches the transfer station B of FIG. 3, it is accepted by the adjacent carrier 61 (which is then nearest to and mirror symmetrical with respect to the carrier 59), and its reorientation is completed while the carrier 61 completes an angular movement through 180°, i.e., from the station B back to the station A of FIG. 3. As mentioned above, the transfer of cigarettes 65A at the station A is effected by suction in the ports 60 of successive carriers 59 simultaneously with interruption of suction in the respective flute 67A of the conveyor 67, the transfer of cigarettes 65A from carriers 59 into the flutes 64 of carriers 61 is effected by terminating the suction in ports 60 of successive carriers 59 while simultaneously connecting the ports 60 of the adjacent carriers 61 to the suction generating devices SG, and the transfer of inverted or reoriented cigarettes 65A' into the flutes 67B of the conveyor 67 is effected by terminating suction in the ports 60 of successive carriers 61 while the flutes 67B communicate with the suction generating device for the conveyor 67 (this suction generating device may be the same device which draws air from the ports 60 of the carriers 59, 61 in certain angular positions of these carriers). The feature that the links 51 are connected to the supports 48, 46 and that the support 48 is eccentric with respect to the support 46 insures that the orientation of cigarettes 65A in carriers 61 changes from a position of perpendicularity with respect to the axis of the shaft 41 (at the station B) to a position of parallelism with such axis at the station A. The shaft 67M causes the flutes 67A, 67B to move sideways along two parallel paths, the supports 44, 47 move the links 49 and carriers 59 along a first endless path which is adjacent to the path for the flutes 67A, and the supports 46, 48 move the links 51 and carriers 61 along a second endless path which is adjacent to the path for flutes 67B.

FIGS. 5 and 6 show a second turn-around device which can convert two rows of filter cigarettes or analogous rod-shaped articles into a single row wherein the inverted cigarettes 165A' alternate with non-inverted cigarettes 165B. All such parts of the second turn-around device which are identical with or clearly analogous to the corresponding parts of the device 27 are denoted by similar reference characters plus 100.

The turn-around device of FIGS. 5 and 6 comprises a first conveyor 167 which replaces the conveyors 67 and 67' of FIG. 2 and wherein the distance between two neighboring flutes 167A, 167B is half the distance between the centers of neighboring flutes on the conveyor 26 (i.e., on the conveyor which supplies pairs of coaxial filter cigarettes 165A, 165B) but equal to the distance between the centers of neighboring flutes of the conveyor 28 (i.e., the conveyor receiving a single row of alternating cigarettes 165B and inverted cigarettes 165A' from the first conveyor 167 of the second turn-around device). The conveyor 26 delivers a pair of coaxial cigarettes 165A, 165B into each second flute (167A) of the first conveyor 167. The second conveyor of the turn-around device thereupon places inverted cigarettes 165A' into empty flutes 167B between successive non-inverted cigarettes 165B to form a single row which is delivered into the flutes of the conveyor 28. Such staggering of inverted cigarettes 165A' with respect to the non-inverted cigarettes 165B is achieved by using a modified intermediate shaft 143 which is a crankshaft (see FIG. 6) and by using carriers 159, 161 whose flutes 164 are offset with respect to the corresponding links 149, 151. In order to effect a reproducible transfer of cigarettes 165A from the flutes 164 of carriers 159 into the flutes 164 of the carriers 161 (at the transfer station B of FIG. 5), the extent to which the flutes 164 are offset with respect to the corresponding links 149, 151 equals one-half the distance between the axes of the two sections 183, 184 of the crankshaft 143. The sections 183, 184 of the crankshaft 143 respectively mount the supports 147, 148 and these supports are coupled to each other by a set of arms 186 each having a first end portion attached to the support 147 by a pin 187 and a second end portion attached to the support 148 by a pin 188. The pins 187, 188 are turnable in the respective supports 147, 148 as well as in the corresponding arms 186. For example, the supports 147, 148 can be coupled to each other by three arms 186, three pins 187 and three pins 188.

The supports 147, 148 are denoted in FIG. 5 by two circles whose centers are respectively located on the axes of the crankshaft sections 183, 184. FIG. 5 merely shows two carriers 159 and two carriers 161; however, it will be understood that the supports 147, 148 may be connected with a much larger number of carriers, e.g., with the same number as shown in FIG. 3. The lower carrier 159 is in a position it assumes when it accepts a cigarette 165A from the conveyor 167, and the lower carrier 161 is shown in a position it assumes during deposition of an inverted cigarette 165A' into an empty flute 167B of the conveyor 167. The upper carrier 159 of FIG. 5 is in the process of delivering a partially reoriented or inverted cigarette 165A into the flute of the adjacent carrier 161. The axes of the sections 183, 184 are spaced apart from each other by a distance $t_2 + t_3$ whereby $t_2$ equals $t_3$ and the dot-dash line X—X of FIG. 5 represents the central symmetry plane of the reorienting conveyor which includes the crankshaft 143. The distance $t_1$ indicates the extent to which the flutes 164 of the carriers 159 are offset relative to the corresponding links 149, and the distance $t_4$ indicates the extent of offset of the flutes 164 of carriers 161 relative to the associated links 151. It will be noted that $t_1$ equals $t_2$, $t_3$ or $t_4$. The distance $t = t_1 + t_2 + t_3 + t_4$ equals the distance between the centers of two neighboring flutes 167A, 167B on the conveyor 167 and the distance between the center of the flute 164 of a carrier 159 at the transfer station A and the center of the flute 164 of a carrier 161 at the station A. Such positioning of the flutes 164 of associated carriers 159, 161 with respect to each other insures that successive carriers 161 deposit inverted cigarettes 165A' into empty flutes 167B of the first conveyor 167, i.e., into those flutes which are flanked by flutes 167A containing non-inverted cigarettes 165B.

The distance $t_2 + t_3$ equals one-fourth the distance between the centers of two neighboring flutes 167A, and the distance $t_1$ or $t_4$ (eccentricity of flutes 164 with respect to the coupling elements of the respective links 149, 151) equals one-eighth of the distance between the centers of two neighboring flutes 167A.

The operation of the turn-around device of FIGS. 5 and 6 is as follows:

The conveyor 167 transports pairs of coaxial cigarettes 165A, 165B toward the transfer station A, and such pairs of cigarettes are received in alternate flutes 167A of the conveyor 167. Successive carriers 159 remove successive cigarettes 165A in the same way as described in connection with FIGS. 2–4, i.e., suction in the corresponding portion of a flute 167A of the conveyor 167 is terminated at the station A and the flute 164 of the carrier 159 at the station A communicates with the inlet of a suction generating device so that the cigarette 165A is lifted by suction and is transported toward the transfer station B while undergoing partial reorientation by 90 degrees. Thus, whereas the cigarette 165A in a flute 167A extends at right angles to the plane of FIG. 5, the cigarette 165A in the flute of a carrier 159 at the station B is parallel to such plane. The partially reoriented cigarette 165A is then accepted by the associated carrier 161 whose flute 164 is then connected with the inlet of the suction generating device while the suction generating device simultaneously ceases to draw air from the flute 164 of the carrier 159 at the station B. The cigarette 165A is thereupon transported back toward the station A and is completely inverted not later than when it assumes the position 165A' shown in FIG. 5. The eccentricity of crankshaft sections 183, 184 with respect to each other enables the reorienting conveyor to move the inverted cigarette 165A' into register with an empty flute 167B of the conveyor 167 and the inverted cigarette 165A' is placed between two non-inverted cigarettes 165B to form therewith a portion of a single row wherein each cigarette 165A' is accurately aligned with the neighboring cigarettes 165B.

The improved turn-around device is susceptible of many additional modifications. For example, the links can be articulately connected with otherwise configurated supports. However, it has been found that simple disk-shaped supports are especially suited for use in the improved device because they are easy to manufacture and can be mounted on the respective shafts with a high degree of accuracy. Moreover, the inertia of disk-shaped supports is relatively low. Accurate mounting of supports on their shafts is desirable in order to insure reproducible reorientation of cigarettes. The provision of cheeks or analogous holders which rigidly connect the intermediate shaft with the two coaxial shafts enhances the stability of the reorienting conveyor and also contributes to reproducible reorientation of cigarettes.

An important advantage of the improved turn-around device is that the carriers 59, 61 or 159, 161 are reliably and accurately guided during each stage of each revolution of the corresponding supports 44, 46, 47, 48 or 144, 146 (both not shown in FIGS. 5–6), 147 and 148. The universal joints for the ends of coupling elements comprises parts which perform relatively small movements with respect to each other so that the generation of heat owing to friction between the relatively moving parts of the universal joints is negligible, i.e., the universal joints need not be lubricated because a nitriding of their external surfaces guarantees sufficient resistance to wear for long periods of time. Lubrication of universal joints is not desirable for obvious reasons, i.e., droplets of lubricant could escape during rotation of the reorienting conveyor and would be likely to contaminate the cigarettes which are in the process of being reoriented and/or the cigarettes on the conveyors which are adjacent to the reorienting conveyor. The supports rotate on antifriction bearings which can be sealed to prevent escape of lubricant.

It has been found that the improved turn-around device is suited for use in machines for the mass-production of rod-shaped articles, especially filter cigarettes, cigars or cigarillos. The likelihood of improper reorientation of rod-shaped articles, of damage to or contamination of articles, or of excessive wear upon moving parts is much less pronounced than in heretofore known turn-around devices. The improved turn-around device can be used in new filter cigarette making as analogous machines or a superior substitute for conventional turn-around devices in existing machines.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, theefore, such adaptations should and are intended to be comprehended within the meaning and range of equivalence of the claims.

What is claimed as new and desired to be protected by Letters Patent is set forth in the appended claims:

1. A turn-around device for cigarettes or analogous rod-shaped articles, comprising first conveyor means having a plurality of first receiving means for articles to be turned, a plurality of second receiving means for turned articles, and means for moving said receiving means sideways along parallel first and second paths and past a first transfer station; second conveyor means having annuli of first and second links respectively adjacent to said first and second paths, first and second suction heads respectively mounted on said first and second links, first and second rotary supports, means for articulately connecting said supports with said first links, means for rotating said supports about parallel axes to move said first links along a first endless path having a first portion which is adjacent to said first station and in which successive first suction heads remove articles from successive first receiving means and a second portion which is adjacent to a second transfer station and in which successive first suction heads maintain the articles substantially at right angles to said receiving means, third and fourth rotary supports, means for articulately connecting said third and fourth supports with said second links, and means for rotating said third and fourth supports about parallel axes to move said second links along a second endless path having a first portion which is adjacent to said second station and in which successive second suction heads accept articles from successive first suction heads and a second portion which is adjacent to said first station and in which successive second suction heads deliver turned articles into successive second receiving means; coaxial first and second shafts for said first and fourth supports; a third shaft for said second and third supports; first and second holders respectively connecting said first and third and said second and third shafts; and a suction generating device, said first and second shafts and said holders defining passages connecting said suction heads with said suction generating device in predetermined angular positions of said supports.

2. A turn-around device as defined in claim 1, wherein each of said connecting means comprises a universal joint.

3. A turn-around device as defined in claim 2, wherein said joints are Cardanic joints.

4. A turn-around device as defined in claim 2, wherein each of said links comprises a coupling element extending between the respective joints and each of said joints comprises a bearing member pivoted to the respective support and pivotably mounting one end of the respective coupling element.

5. A turn-around device as defined in claim 4, wherein said bearing members are pivotable about first axes which are substantially tangential to the respective supports and said coupling elements are elongated rods having end portions which are pivotable in said bearing members about second axes normal to the respective first axes.

6. A turn-around device as defined in claim 2, wherein each of said joints comprises a plurality of relatively movable parts having nitrided surfaces so that such parts can move relative to each other without lubrication and with a minimum of wear upon said surfaces.

7. A turn-around device as defined in claim 1, wherein said supports are parallel disks and said shaft are stationary.

8. A turn-around device as defined in claim 7, wherein said first and second shafts are spaced apart from each other and said third shaft is disposed between said first and second shafts, said first and second holders being respectively rigid with said first and second shafts and supporting said third shaft.

9. A turn-around device as defined in claim 8, wherein said means for rotating said first and second supports comprises a rotary driving member mounted on said first shaft and arranged to transmit torque to said first support, said second support being rotated by said first links in response to rotation of said first support.

10. A turn-around device as defined in claim 9, wherein said first holder is a cheek rigid with said first and third shafts and said second holder is a cheek rigid with said second and third shafts.

11. A turn-around device as defined in claim 1, wherein said second and third supports have additional passages connecting the passages of said holders with the respective suction heads.

12. A turn-around device as defined in claim 11, wherein the connecting means between said second and third supports and the respective links are provided with further passages connecting said additional passages with said suction heads.

13. A turn-around device as defined in claim 11, wherein said second and third supports have means for controlling the flow of air from said suction heads to said suction generating device.

14. A turn-around device for cigarettes or analogous rod-shaped articles, comprising first conveyor means having a plurality of first receiving means for articles to be turned, a plurality of second receiving means for turned articles, said second receiving means alternating with said first receiving means, and means for moving said receiving means sideways along parallel first and second paths and past a first transfer station; and second conveyor means having annuli of first and second links respectively adjacent to said first and second paths, first and second article carriers respectively mounted on said first and second links, first and second rotary supports, means for articulately connecting said supports with said first links, means for rotating said supports about parallel axes to move said first links along a first endless path having a first portion which is adjacent to said first station and in which successive first carriers remove articles from successive first receiving means and a second portion which is adjacent to a second transfer station and in which successive first carriers maintain the articles substantially at right angles to said receiving means, third and fourth rotary supports, means for articulately connecting said third and fourth supports with said second links, and means for rotating said third and fourth supports about parallel axes to move said second links along a second endless path having a first portion which is adjacent to said second station and in which successive second carriers accept articles from successive first carriers and a second portion which is adjacent to said first station and in which successive second carriers deliver turned articles into successive second receiving means, the axis of said first support being common to the axis of said fourth support and the axes of said second and third supports being parallel to each other and to the common axis of said first and fourth supports.

15. A turn-around device as defined in claim 14, wherein said carriers are suction heads.

16. A turn-around device as defined in claim 14, further comprising coaxial first and second shafts rotatably mounting said first and fourth supports and a crankshaft having a first section rotatably mounting said support and a second section rotatably mounting said third support.

17. A turn-around device as defined in claim 14, wherein said first carriers are angularly offset with respect to said second carriers.

18. A turn around device as defined in claim 14, wherein the shortest distance between said second and third axes equals the shortest distance between the axes of said second and third supports and wherein said first and second carriers are respectively offset relative to the corresponding links by half said distance.

19. A turn-around device as defined in claim 18, wherein said distance equals one fourth the distance between the centers of two neighboring first receiving means.

* * * * *